United States Patent [19]

Jackson

[11] 4,244,326

[45] Jan. 13, 1981

[54] STEAM GENERATING SYSTEM

[76] Inventor: Dennis H. Jackson, 850 W. Osborn Rd., Phoenix, Ariz. 85013

[21] Appl. No.: 29,402

[22] Filed: Apr. 12, 1979

[51] Int. Cl.[3] ..... F22B 33/00

[52] U.S. Cl. ..... 122/20 B; 122/135 R; 126/365

[58] Field of Search ..... 122/20 B, 135, 136, 122/171, 113, 183, 247, 249, 464, 465, 468, 138, 7 R; 126/364, 365; 165/DIG. 2; 110/206, 207

[56] References Cited

U.S. PATENT DOCUMENTS

| | | | |
|---|---|---|---|
| 2,515,869 | 7/1950 | Gregg et al. | 110/203 |
| 2,998,807 | 9/1961 | Clarkson et al. | 122/249 |
| 3,364,902 | 1/1968 | Horton | 122/249 |
| 3,858,556 | 1/1975 | Terentiev et al. | 122/7 R |
| 4,020,797 | 5/1977 | Hug | 122/249 X |

FOREIGN PATENT DOCUMENTS

| | | | |
|---|---|---|---|
| 155666 | 10/1932 | Sweden | 126/365 |
| 550475 | 1/1943 | United Kingdom | 122/249 |

*Primary Examiner*—Edward G. Favors

*Attorney, Agent, or Firm*—Sughrue, Rothwell, Mion, Zinn & Macpeak

[57] ABSTRACT

All of the hot flue gases from a furnace are collected and passed through a conduit extending through a closed heat chamber. A plurality of steam coils are disposed about the conduit within the heat chamber at spaced locations along the length of the conduit. Each steam coil is connected to a common water header located within the heat chamber parallel to the conduit. The water header is supplied with water which may be preheated in a suitable water jacket disposed in contact with the outlet end of the conduit outside the heat chamber. Each steam coil has a gradually increasing diameter with the largest diameter end of the coil passing outwardly through an aperture in the heat chamber for delivering steam to be used in any desired manner. A pair of parallel spaced apart pipes extend parallel to the conduit from one end of the heat chamber to the other. One of the pipes is closed at one end and the other pipe is closed at the opposite end. The open ends of each pipe are connected to L-shaped pipe sections which extend radially outwardly through the wall of the heat chamber and are connected to opposite ends of a suction blower unit. Each pipe is provided with a plurality of apertures, each of which opens radially inwardly toward a respective steam coil. Curved semi-cylindrical flanges extend in opposite directions from each aperture in spaced relation to a circumferential portion of the respective steam coil to provide a vigorous circulation of air about each steam coil.

10 Claims, 5 Drawing Figures

STEAM GENERATING SYSTEM

BACKGROUND OF THE INVENTION

1. Field of the Invention

The present invention is directed to a steam generating system and more specifically to a system using hot flue gases from a furnace which would ordinarily be dissipated to the atmosphere without utilization of the heat.

2. Prior Art

Applicant's U.S. Pat. No. 4,138,852 and the patent to Hoad U.S. Pat. No. 3,670,669 both disclose the broad idea of utilizing the heat generated by an industrial furnace, incinerator or the like for the production of steam prior to the dissipation of the hot flue gases to the atmosphere. However, the systems disclosed in these patents only refer to heat exchanger means in a broad schematic manner and fail to disclose a compact, efficient heat exchanger suitable for the purpose.

SUMMARY OF THE INVENTION

The present invention provides a steam generation system which utilizes the hot flue gases from an industrial furnace, incinerator or the like for the generation of steam in a compact and efficient heat exchanger.

The present invention is directed to a steam generation system wherein all of the flue gases from a furnace are directed through one or more conduits each of which extends through a closed heat chamber. Within the heat chamber, a plurality of heat exchanger coils extend about the conduit in spaced relation to each other along the length thereof. Each heat exchanger coil is comprised of a pipe having a gradually increasing diameter which is wrapped about the conduit for a predetermined number of turns. The smaller diameter end of the pipe is connected to a water header located within the heat chamber parallel to the conduit. The larger diameter end of each pipe coil extends outwardly through the wall of the heat chamber to deliver the steam to a turbine generator or the like. A pair of spaced apart hot air distribution pipes extend parallel to the conduit from one end of the chamber to the other. One hot air distribution pipe is closed at one end and the other hot air distribution pipe is closed at the opposite end. The open ends of each hot air distribution pipe are connected to L-shaped pipe sections which extend radially outwardly through the walls of the heat chamber where they are connected to opposite ends of a suction blower unit. A plurality of apertures are located in each hot air distribution pipe immediately adjacent to and directed toward each heat exchanger coil. A pair of curved semi-cylindrical flanges are secured to the heat distribution pipe on opposite sides of each aperture and extend partially about the circumference of each coil in spaced relation thereto. Upon operation of the suction blower unit, a forced circulation of hot air about the heat exchanger coils will be set-up to obtain the maximum utilization of the heat within the chamber for the efficient production of steam. Regulated air intake means are provided for the conduit between the furnace and the heat chamber and downstream of the heat chamber to regulate the temperature of the flue gases. Excess heat within the heat chamber can be drawn off for any desirable useful purpose such as heating a building or the like.

The foregoing and other objects, features and advantages of the invention will be apparent from the following more particular description of a preferred embodiment of the invention as illustrated in the accompanying drawings.

DETAILED DESCRIPTION OF THE INVENTION

Figure 2:
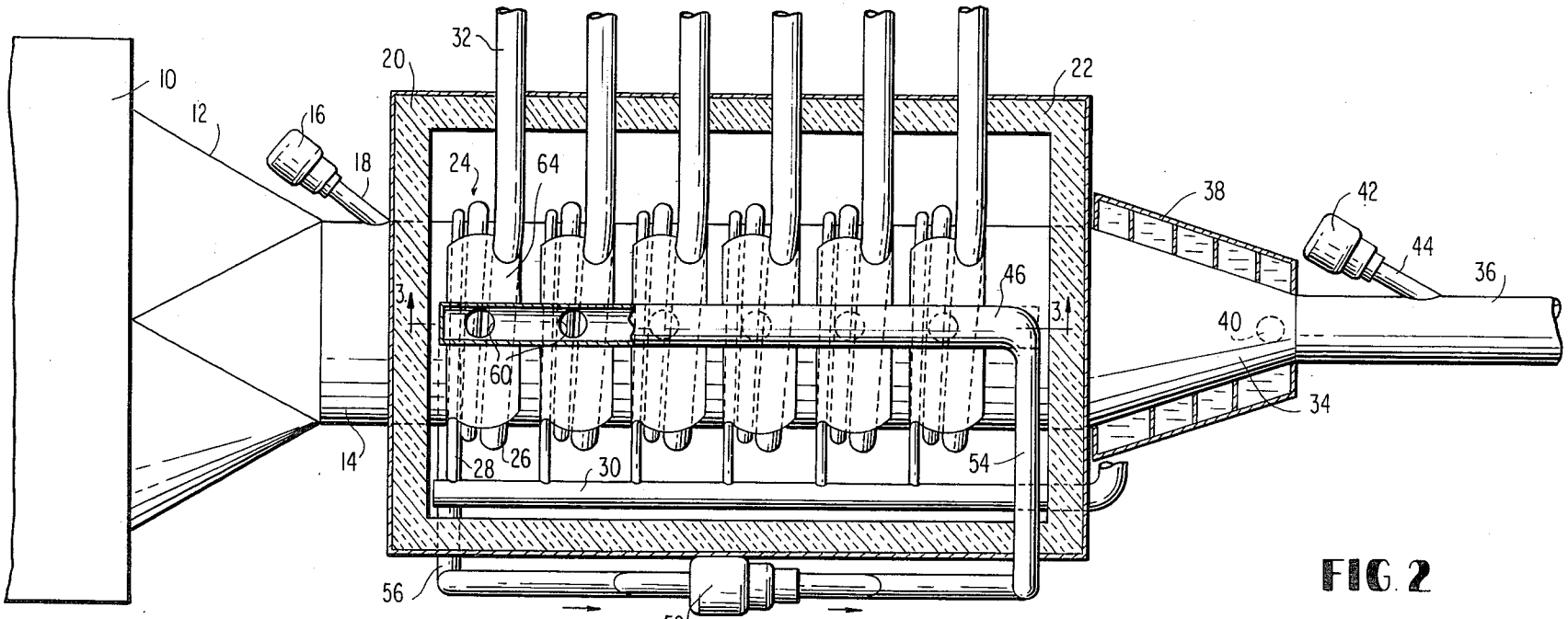
FIG. 2 is a section view taken along the line 2—2 of FIG. 1.
Figure 3:
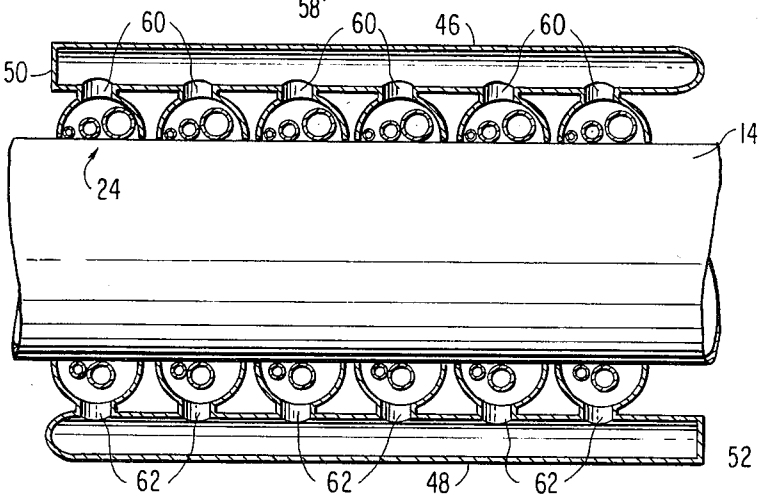
FIG. 3 is a partial section view taken along the line 3—3 of FIG. 2.

The steam generating system according to the present invention includes a furnace 10 of any suitable type which produces high temperature flue gases such as industrial furnaces, incinerators or commerical furnaces of the type used for heating large buildings or the like. All of the flue gases emanating from the furnace 10 are collected by the hood 12 and directed into a conduit 14. While only a single conduit 14 has been shown in the present application, it is understood that for furnaces having a very large flue gas output, the flue gases could be directed to a plurality of conduits similar to the conduit 14 by a suitable system of feeder conduits and valves. While the flue gases are shown in FIG. 2 as being fed directly into the conduit 14 from the furnace 10, it is conceivable that the flue gases could be passed through other apparatus prior to entering the conduit 14. For example, if the flue gas temperatures for a particular furnace are so high that they would be destructive of the heat exchangers which will be described hereinafter, it would be necessary to pass the flue gases through one or more cooling stages. Also, a blower unit 16 is provided for introducing atmospheric air into the conduit 14 through the conduit 18 for the purpose of regulating the temperature of the flue gases entering into the heat chamber 20. The blower unit 16 can be operated manually or automatically in dependence on the desired temperature.

The conduit 14 extends through an insulated heat chamber 20 from one end to the other. The chamber 20 is completely lined with insulation 22 to capture and hold the heat radiating from the conduit 14 to increase the efficiency of the heat exchangers. The heat exchangers are comprised of a plurality of identical steam coils 24 each of which is comprised of a plurality of turns of a pipe 26 about the circumference of the conduit 14. The pipe 26 has a gradually increasing diameter with the smaller diameter end 28 being connected to a water header 30. The large diameter end 32 of the pipe 26 extends outwardly through an aperture in the heat chamber 20 to deliver steam for any suitable purpose, such as the generation of electricity or the like. The number of turns of each steam coil about the conduit, the spacing between the steam coils and the number of steam coils within the heat chamber all depend upon the type of furnace associated with the heat exchangers and the temperature of the flue gases emanating from the furnace. For example, it is estimated that there are approximately 55,000 commerical furnaces in the United States wherein the temperature range of the flue gases is approximately 1,000° F. For such an installation the length of the heat exchanger assembly would be anywhere from 6 to 30 feet and for every two feet of heat exchanger length, a steam coil would be wrapped around the outside of the conduit. The heat chamber of the heat exchanger would be made from high heat resistant stainless steel approximately ¼ inches thick. The conduit of the heat exchanger would be mounted in the heat chamber at a drop position of 1 inch to the foot from the inlet end of the exchanger to the outlet end. For industrial furnaces having much higher temperature flue gases, the heat exchanger assembly would be anywhere from 30 to 70 feet in length and the conduits within the heat exchanger assembly would be from 4 to 8 feet in diameter. For large installations of this nature an intermediate brace would be required every 6 to 8 feet of exchanger length to provide additional support. In addition to having the downward slope within the heat chamber, the conduit would be connected to a reducing conduit section 34 at the outlet end of the heat chamber. Such a section would quickly reduce the diameter of the conduit from the 4 to 8 foot diameter inside the heat chamber to approximately 2 to 3 feet at the smaller end to which an outlet pipe 36 would be connected. The bottom of the reducing section 34 would also have the same downward slope as the conduit 14 within the heat chamber 20 so that there would be no place for the solid matter being pulled through the heat exchanger by the suction blower unit to bolt or buildup within the heat exchanger.

In order to preheat the water being supplied to the water header 30 a spiral water jacket 38 is provided about the circumference of the conduit section 34. Water would be supplied to the water jacket 38 by means of the pipe 40 at the smaller diameter end of the section 34 and the water header 30 would be connected to the spiral water jacket 38 at the larger diameter end thereof. In this way, the water would be preheated by passing in contact with the external surface of the conduit section 34, before passing to the steam coils via the header 30. The outlet pipe 36 is also provided with a blower unit 42 for supplying outside air through the pipe 36 by way of pipe 44 to modify the temperature of the flue gases within the outlet pipe 36. The blowers 16 and 42 also will assist in forcing the flue gases through the heat exchanger assembly.

Figure 1:
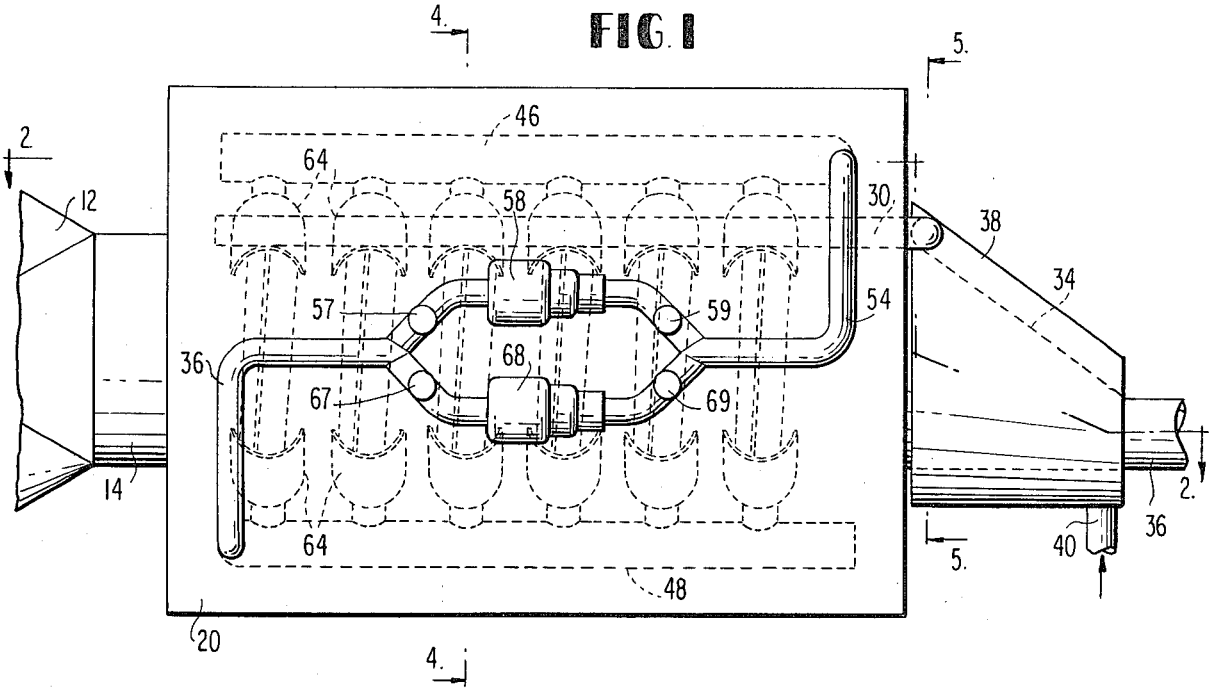
FIG. 1 is a side elevation view of the steam generating apparatus according to the present invention.
Figure 4:
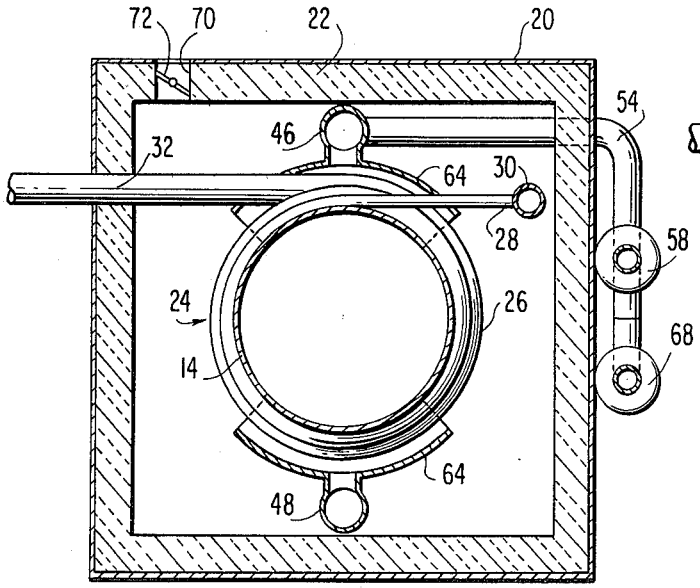
FIG. 4 is a section view taken along the line 4—4 of FIG. 1.
Figure 5:
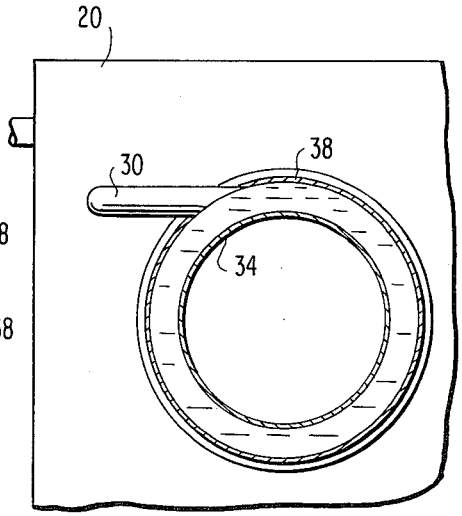
FIG. 5 is a section view taken along the line 5—5 of FIG. 1.

In order to promote the circulation of hot air within the heat chamber 20 in close proximity to the steam coils 24 to increase the efficiency thereof, an air circulating system has been provided. A pair of parallel spaced apart air pipes 46 and 48 are disposed parallel to the conduit 14 and extend substantially the entire length of the heat chamber 20. The pipe 46 is provided with a closure plate 50 at one end and the pipe 48 is provided with a closure plate 52 at the opposite end. The two other ends of the pipes 46 and 48 are connected to L-shaped pipe sections 54 and 56, respectively, which in turn, are connected to opposite ends of two suction blower units 58 and 68. The pipe 46 is provided with a plurality of apertures 60 and the pipe 48 is provided with a plurality of similar apertures 62. These apertures are located on the sides of the pipes directed radially toward a respective steam coil 24. A semi-cylindrical curved flange 64 extends in opposite directions from each aperture 60 and 62 in opposite circumferential directions about the periphery of each coil 24 in closely spaced relation thereto. Thus, upon operation of suction blower unit 58 or 68, hot air will be drawn into the pipe 48 from around the lower portions of the steam coils 24 and will be forced through the other pipe 46 through the apertures 60 around the upper portions of the steam coils 24. It is preferable to have the suction blower units 58 and 68 located outside of the heat exchanger since the extremely high temperatures therein might have a deleterious effect on the motor of the suction blower unit. However, the portions of the pipes 54 and 56 which extend outwardly of the heat chamber 20 can be fully insulated to prevent any undue loss of heat. Thus, the air circulation system provides a closed circulation of hot air about the peripheries of the heat coils 24 to increase the efficiency of the steam generating system. While the pipes 46 and 48 have been illustrated as being diametrically opposed in the present application, the exact spacing between these pipes can be varied depending upon the particular needs of any installation. As shown in FIG. 1, the suction blower units 58 and 68 are connected to the pipes 54 and 56 in parallel. Valves 57 and 59 are provided at opposite sides of unit 58 and valves 67 and 69 are disposed on opposite sides of unit 68. If unit 58 is in operation valves 57 and 59 will be open and valves 67 and 69 will be closed. If unit 68 is in operation the valves 57 and 59 will be closed and valves 67 and 69 will be open. Thus, if one of the secution blower units breaks down or needs servicing, the other suction blower unit may be placed into service so that a continuous circulation of hot air about the steam coils 24 can be achieved. While the flow of air through the suction blower units 58 and 68 is shown in the direction of the arrows in FIG. 2, it is obvious that the direction of the flow of the air could be reversed if desired. One or more vent ports such as the port 70 shown in FIG. 4 may be provided in the top of the heat chamber 20 to provide for the removal of excess heat from the heat chamber. A suitable valve such as the butterfly valve 72 shown schematically in FIG. 4 may be provided to control the flow of hot air from the chamber 20. The hot air may be directed by any suitable conduit system for any desired use such as drying the coal to be used in the furnace or for providing heat to various building structures or the like.

The system according to the present invention is compatible with the system disclosed in applicant's U.S. Pat. No. 4,138,852 for cleaning the flue gases. The exhaust pipe 36 of the present system would be connected to the pipe 16 shown in the patent. Thus, the conventional flue for industrial and commerical furnaces would be eliminated and the suction blower units 18*a*, 18*b* of the patent would control the draft for the furnace. The combination of the two systems would therefore efficiently utilize the vast quantities of heat normally wasted by such furnaces and provide an efficient draft control means for the furnace and an efficient pollution control for the exhaust gases.

While the invention has been particularly shown and described with reference to a preferred embodiment thereof, it will be understood by those in the art that various changes in form and details may be made therein without departing from the spirit and scope of the invention.

What is claimed is:

1. A steam generating system comprising a heat chamber, at least one conduit extending completely through said heat chamber, collecting means for collecting flue gases from at least one furnace and directing said flue gases through said conduit, a plurality of separate steam coils wrapped about said conduit in spaced relation to each other along the length of said conduit within said heat chamber, first pipe means for supplying water to one end of each steam coil and second pipe means for removing steam from the other end of each steam coil and air circulating means for circulating the hot air within said heat chamber in a circumferential direction about the circumference of each steam coil.

2. A steam generating system as set forth in claim 1, wherein each steam coil is comprised of a pipe having a gradually increasing diameter wrapped about said conduit a plurality of turns.

3. A steam generating system as set forth in claim 2, further comprising a common water header located in said heat chamber with the smaller diameter end of each steam coil being connected thereto for receiving water.

4. A steam generating system as set forth in claim 3, further comprising exhaust conduit means connected to said conduit at the opposite end from said collecting means and heat exchanger means in contact with said exhaust conduit means and connected to said header for preheating water being supplied to said header and said steam coils.

5. A steam generating system as set forth in claim 4, wherein said exhaust conduit means includes a section having a reducing diameter with the larger diameter end thereof connected to the conduit and equal to the diameter thereof, said reducing diameter section and said conduit being disposed in substantially horizontal alignment with a slight downward slope for the lowermost sides thereof.

6. A steam generating system as set forth in claim 1, wherein said air circulating means is comprised of two parallel spaced apart pipes disposed in said heat chamber parallel to said conduit in close proximity to said steam coils, each of said pipes having a plurality of apertures spaced along the length thereof on the side thereof facing said steam coils and in alignment with each steam coil respectively and suction blower means connected to opposite ends of said pipes for circulating hot air about the circumference of said steam coils.

7. A steam generating system as set forth in claim 6, wherein a plurality of pairs of curved semi-cylindrical flanges are secured to each pipe on opposite sides of each aperture for channeling the flow of hot air about the circumference of each coil from the apertures in one pipe to the apertures in the other pipe.

8. A steam generating system as set forth in claim 7, wherein said suction blower means is comprised of two suction blower units connected in parallel to the opposite ends of said pipes.

9. A steam generating system as set forth in claim 1, further comprising an outlet conduit section connected to said conduit outside said heat chamber and blower means connected to said collecting means and said outlet conduit means for supplying outside air to the flue gases in the direction of flow.

10. A steam generating system as set forth in claim 1, further comprising valved outlet means in said heat chamber for controlling the flow of hot air outwardly of said heat chamber for heating purposes.

* * * * *